US006435110B1

(12) United States Patent
Keil

(10) Patent No.: US 6,435,110 B1
(45) Date of Patent: Aug. 20, 2002

(54) MOBILE VETERINARY TREATMENT PREP TABLE

(75) Inventor: Charles C. Keil, Fort Collins, CO (US)

(73) Assignee: dbl.7 LLC, Loveland, CO (US)

( * ) Notice: Subject to any disclaimer, the term of this patent is extended or adjusted under 35 U.S.C. 154(b) by 26 days.

(21) Appl. No.: 09/639,033

(22) Filed: Aug. 14, 2000

Related U.S. Application Data

(62) Division of application No. 09/215,568, filed on Dec. 16, 1998, now Pat. No. 6,610,956.
(60) Provisional application No. 60/069,720, filed on Dec. 16, 1997.

(51) Int. Cl.[7] ..... A47B 9/00
(52) U.S. Cl. ..... 108/147
(58) Field of Search ..... 108/147, 144.11; 5/611, 601; 297/452.39

(56) References Cited

U.S. PATENT DOCUMENTS

| | | | | | |
|---|---|---|---|---|---|
| 3,608,462 | A | * | 9/1971 | Groshong | 108/147 X |
| 3,694,830 | A | * | 10/1972 | Koller | 5/611 X |
| 3,797,819 | A | * | 3/1974 | Platz et al. | 108/147 X |
| 4,195,829 | A | * | 4/1980 | Reser | |
| 4,558,847 | A | * | 12/1985 | Coates | |
| 4,885,998 | A | * | 12/1989 | Span et al. | 5/616 X |
| 5,156,166 | A | * | 10/1992 | Sebring | 5/611 X |
| 5,271,113 | A | * | 12/1993 | White | 5/611 |
| 5,528,782 | A | | 6/1996 | Pfeuffer et al. | |
| 5,715,548 | A | * | 2/1998 | Weismiller et al. | 5/611 X |
| 5,826,286 | A | * | 10/1998 | Cranston | |
| 6,101,956 | A | * | 8/2000 | Keil | 108/147 |

FOREIGN PATENT DOCUMENTS

GB 981280 * 1/1965

OTHER PUBLICATIONS

Electric Lift Exam and Weight Tables, p. E3, Shoreline Catalog (1995).*
Electric Lift Exam Table, p. G2, Shoreline Catalog (1995).*
Cojack Table, "Power Lift", p. H9, Shoreline Catalog (At Least Avail. By 1996).*
Stainless Steel Lift Tables, p. 43, Suburban Surgical Company, Inc. (At Least Available By 1996).*
Classic Spring Scale Lift Tables, p. 44, Suburban Surgical Company, Inc. (At Least Avail. By 1996).*
Mobile Electric Lift and Electric Exam Table, p. 4.*
Crossroads Medical Supply (At Least Avail By 1996).*
Photos of Product Potentially Offered for Sale By Inventor About Jan. 1997.*
VSSI Brochure "'The Back Saver' Adjustable Gurney," Jan. 28, 2002; 1 page.
Imperial Vet–Mate Lift Table, Suburban Surgical Company catalog, pp. 123 (Feb. 2000).
Multi–purpose COJACK® table, "Power Lift" For Transport, Exam, Treatment, Surgery, and X–Ray, Shoreline catalog, p D–14, (1995).
Mini Mobile Treatment/Prep Lift Table, 2000 Product Catalog, dbl.7, SOLO–TECH™, (1997).
U.S. application No. 60/035,206, entitled, Mobile Veterinary Treatment Prep Table, filed Jan. 10, 1997.
U.S. application No. 09/215,568, entitled, "Mobile Veterinary Treatment Prep Table", filed on Dec. 16, 1998.

* cited by examiner

*Primary Examiner*—Jose V. Chen
(74) *Attorney, Agent, or Firm*—Santangelo Law Offices, P.C.

(57) ABSTRACT

The present invention relates to a veterinary medical lift device to treat animals. Specifically, this invention relates to a mobile veterinary preparation table with a sloping flange or an angled ramp that is height-adjustable and that allows a large degree of ease in relocating an animal to the top of the table. In another embodiment it may also relate to a fixed exam table which lowers close to the floor and which would have its height adjustable table situated such that it would be perpendicular to the wall.

42 Claims, 8 Drawing Sheets

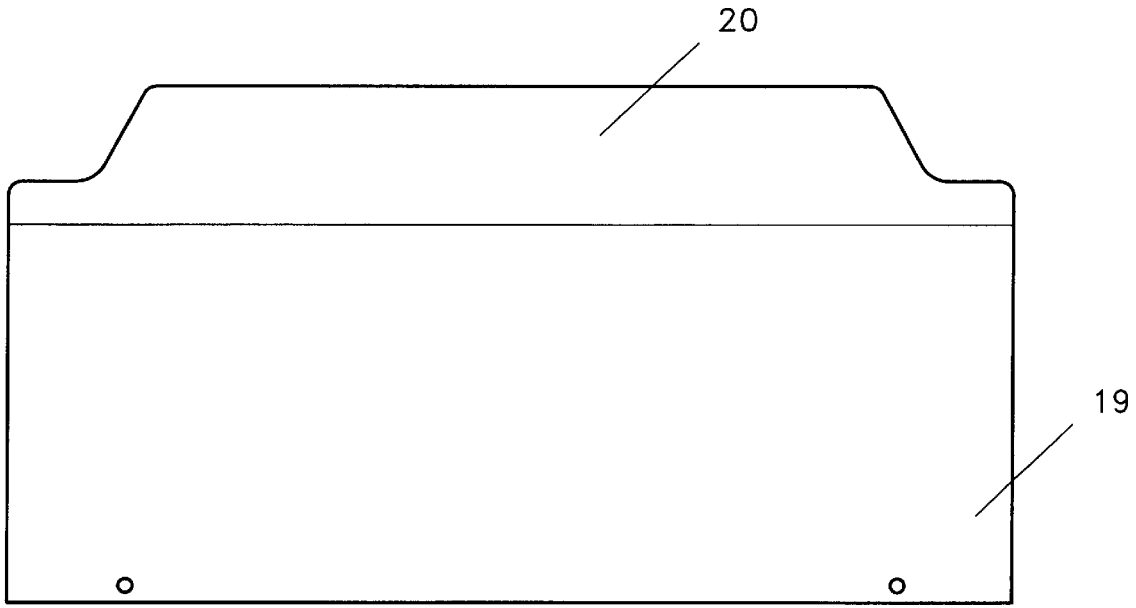
Fig. 2a
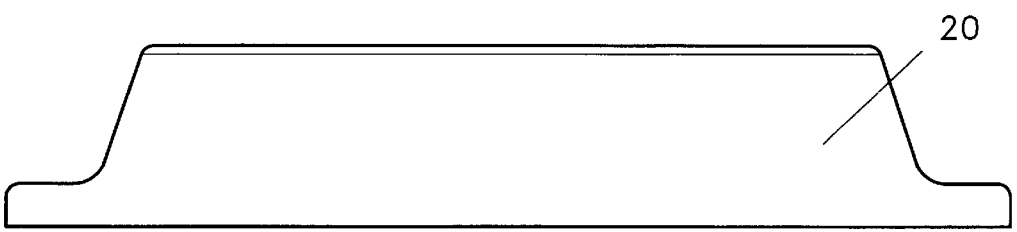
Fig. 2b
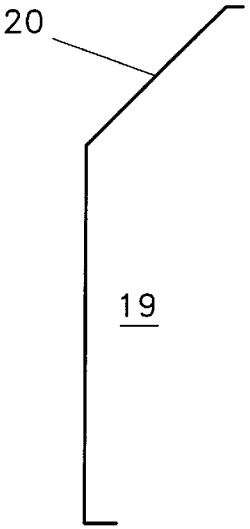
Fig. 2c
Fig. 2

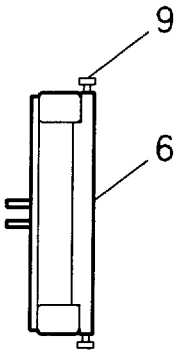
Fig. 3c
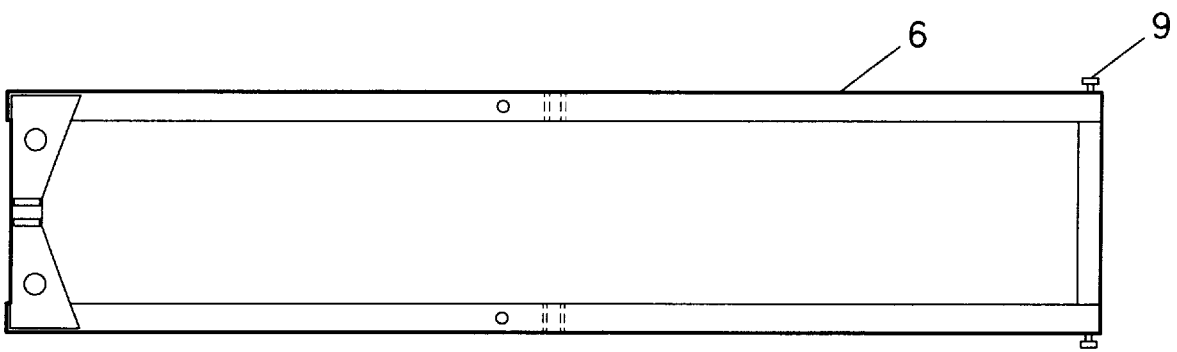
Fig. 3a
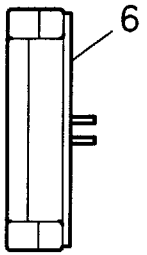
Fig. 3d
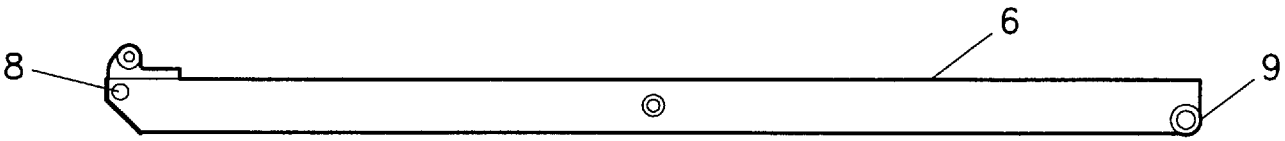
Fig. 3b
Fig. 3

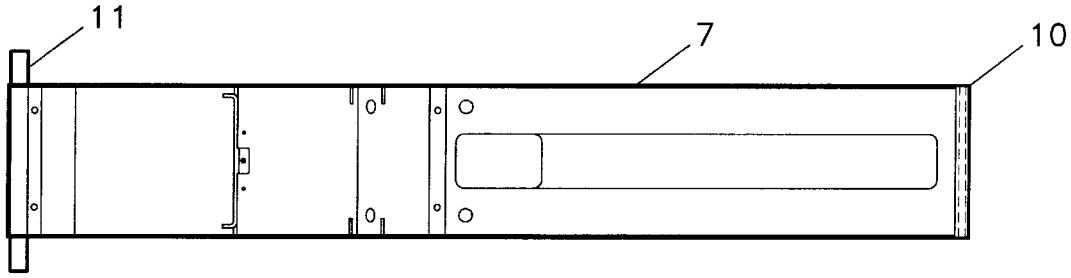
Fig. 4b
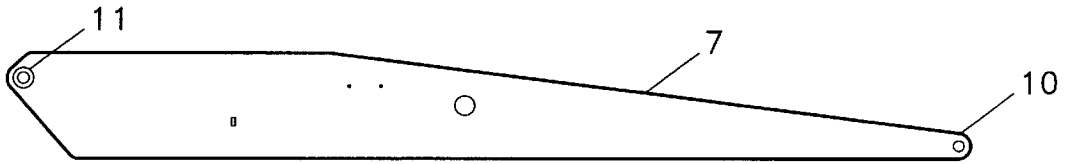
Fig. 4a
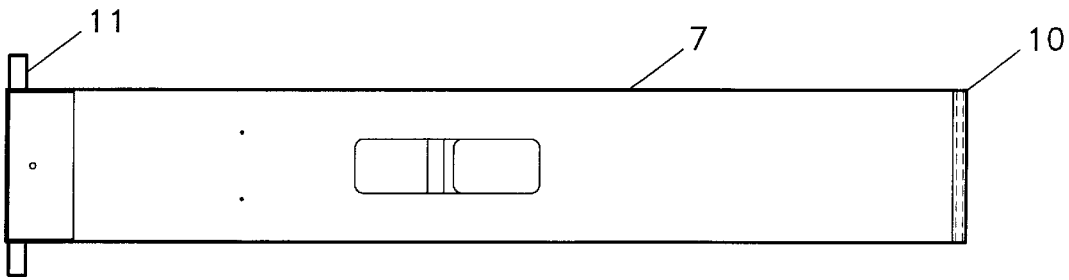
Fig. 4c
Fig. 4

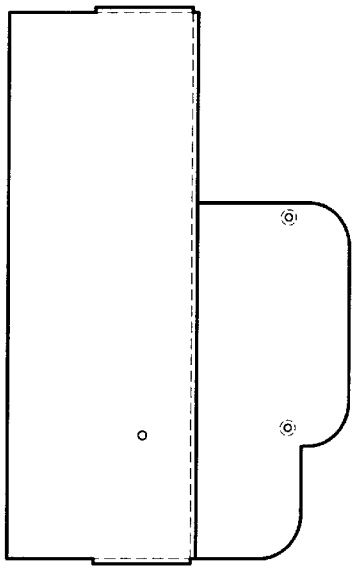
Fig. 5c
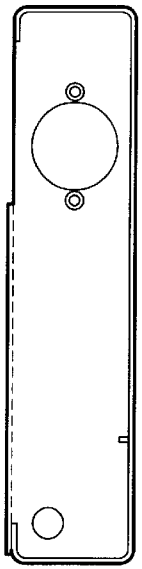
Fig. 5a
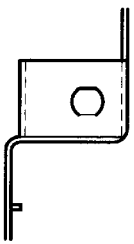
Fig. 5b
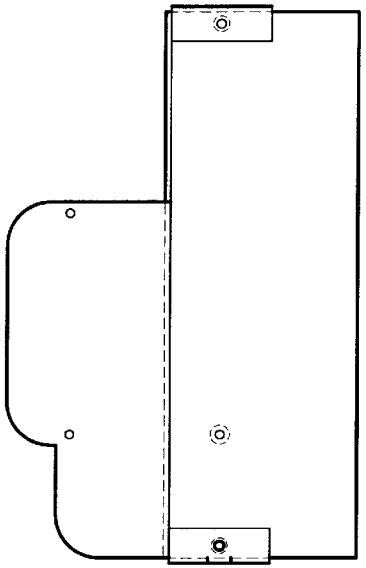
Fig. 5d
Fig. 5

MOBILE VETERINARY TREATMENT PREP TABLE

This is a division application of U.S. application Ser. No. 09/215,568 filed on Dec. 16, 1998 which issued as U.S. Pat. No. 6,610,956 on Aug. 15, 2000 and which claims the benefit of U.S. Provisional Application No. 60/069720 filed on Dec. 16, 1997. The contents of each application are hereby incorporated by reference.

This application claims the benefit of the provisional application (S/N: 60/069720) filed on Dec. 16, 1997. The contents of that application are hereby incorporated by reference.

The field of invention relates to a veterinary medical lift device. Specifically the field relates to a mobile veterinary preparation table. In another embodiment it may also relate to a fixed exam table, that is one that does not have mobility, which lowers close to the floor, perhaps to four or five inches, and which would have its lift table situated such that it would be perpendicular to the wall.

BACKGROUND OF THE INVENTION

For many years, veterinarians have realized the efficiency of placing an animal on a table for various medical treatments. Naturally, therefore, the art is crowded with various devices for such purposes. It would seem improbable that further improvements could be fundamentally possible. However, the present invention shows that this view is untrue.

In reviewing the general state of the art, it is apparent that a gap is missing in the field of veterinary preparation tables. The gap is filled by the present invention. The gap that is missing includes the ability of a medical person to easily move an animal onto a table. The animal may be in a sedated condition at the time of the move. The present device allows a change of elevation prior to moving the animal onto the device as well as a particularly shaped upper table configuration to ease in the relocation of the animal onto the table.

In the instance of the fixed exam table, the table may lower to within four inches of the floor enabling a dog to step upon the table and be raised to a height of 40 inches from the floor or anywhere in between, to facilitate examination without lifting the animal. By making the lifting table portion of the fixed exam table perpendicular to the wall instead of parallel to the wall, both sides of the animal can be examined without lowering the table and repositioning the dog, perhaps a large dog, and again raising the exam table to desired examination height. It is again surprising that the present invention fills this gap even though the field is crowded with a wide variety of devices and improvements. Certainly, those in the art appreciated that a problem existed in attempting to make more suitable and easier the lifting of the animal, in the exam room or treatment area, yet apparently failed to appreciate the solution.

This area of improvement has heretofore gone unnoticed in spite of a long felt need and a long available arts and elements. What is surprising is that the present invention fills the gap even though the field is crowded with a wide variety of devices and improvements. With the field crowded, it may be apparent that those skilled in the art made substantial attempts to fill the need, but were unsuccessful in achieving what the present invention accomplishes. In contrast, the apparent direction of the art was to teach away from the technical direction of the present invention in that, among other aspects, previous tables were generally flat in nature and did not lower with the ease and variety of elevations nor with the shape of the table that the present invention teaches. Furthermore, the present invention is unique in its combination of results from what some could consider available elements.

SUMMARY OF THE INVENTION

The present invention involves a unique awareness of the need and solution to relocate an animal, perhaps a large, sedated animal, onto a veterinarian's preparation table. Typically, at least for larger animals in a sedated condition, at least two people were required to pick the animal up and place it on a table set at a higher certain elevation for the medical personnel to perform medical procedures on the animal. The difficulty lay in relocating the animal from the lower position, such as on a floor, to a higher position where the height was suitable for performing medical procedures. Even if the person was strong enough to physically relocate the animal without assistance, the job was perhaps cumbersome and uncomfortable. The present invention easily and simply lowers to an elevation that allows the medical personnel to slide the animal onto a table, then raise the table to a suitable and adjustable elevation. Furthermore, the shape of the table is unique in that it includes a side sloping flange or an angled ramp that may lower typically to within approximately one inch of the floor to further allow ease in relocating the animal onto the table by sliding the animal up the incline. This focused direction of the present invention allows a large degree of movement, comfort, and ease of relocation. Typically, in using this device, a single individual may sedate an animal, perhaps a larger animal, lower the table to an elevation which may be typically within one inch from the lower edge of the side sloping flange to the floor, step to the back of the prep table, reach over the table, grasp the animal and slide the animal up the side sloping flange onto the upper surface of the table and then raise the table to a desired elevation.

Thus, one object of the present invention is to provide a veterinarian's preparation table that allows a large degree of ease in relocating an animal to the top of the table by using a height adjustable table that may comprise a frame assembly, an elevation support assembly, an elevation assembly, and an elevating actuator. One goal of this object is to provide pivoting leg assemblies that may articulate in an elevation fashion. A second object of this goal is to provide an elevation actuator that may assist in raising the table to a desired elevation such as could be performed by a adjustable screw element, a hydraulic or pneumatic cylinder, or other elevation elements. Another object of this goal is to provide a table having a side sloping flange to assist in obtaining a lower effective elevation of the table and to assist in sliding an animal onto the upper surface of the table. A further object of this goal is to provide a mobile unit. Another object of this goal is to provide rolling elements to aid in mobility of the height adjustable table. Another object of this goal is to provide additional mobility by providing a self contained power unit which may assist in actuating the elevating adjustments.

Another object of the present invention is to provide the veterinarian with an exam table that allows he/she to examine both sides of the animal without taking the time to lower a parallel to the wall table and turn the animal around, raise the table back up, and examine the animal's other side. This could be accomplished by using a height adjustable table that may comprise a frame assembly, an elevation support assembly, an elevation assembly, and an elevating actuator. One goal of this and other projects is to provide an elevation actuator that may assist in raising the table to a desired elevation such as could be performed by an adjustable screw element, a hydraulic or pneumatic cylinder, or other elevation elements. Another object of this goal is to provide a table surface that is soft, warm, and easily cleanable which is perpendicular to the wall of the exam room to facilitate lifting and examining both sides of an animal from one position.

Another goal for the invention is to weigh the animal and display the weight on a read out, perhaps a LED system. Another goal is to have an elevation actuator to perform the task of lifting the table using a height adjustable method, perhaps limit switches, to control the overall distance traveled.

Naturally, further goals and objects of the invention are disclosed throughout other areas of the specification, drawings, photographs, and claims.

A BRIEF DESCRIPTION OF THE FIGURES

FIGS. 1–6 represent one of the preferred embodiments of the present invention and FIGS. 7–8 represent another preferred embodiment of the present invention.

FIG. 1 represents an exploded view of the mobile veterinary medical lift table.

FIG. 2 illustrates the table surface. 2*a*. a plan view of the table surface; 2*b*. a side view; and 2*c*. a right view.

FIG. 3 shows the first leg assembly. 3*a*. a plan view; 3*b*. a side view; 3*c*. a left view, and 3*d*. a right view.

FIG. 4 shows the second leg assembly. 4*a*. a side view; 4*b*. a bottom view; and 4*c*. a top view.

FIG. 5 illustrates the power box. 5*a*. a plan view; 5*b*. a top view, 5*c*. a left view; and 5*d*. a right view.

FIG. 6 shows the lower frame assembly. 6*a*. An elevated perspective view of the lower frame assembly; 6*b*. a plan view; 6*c*. a side view, and 6*d*. a left view.

FIG. 7 represents a front perspective view of the second preferred embodiment of the present invention, i.e., the fixed model.

FIG. 8 shows an exploded view of the second preferred embodiment of the present invention, i.e., the fixed model.

DETAILED DESCRIPTION OF THE PRESENT INVENTION

Figure 1:
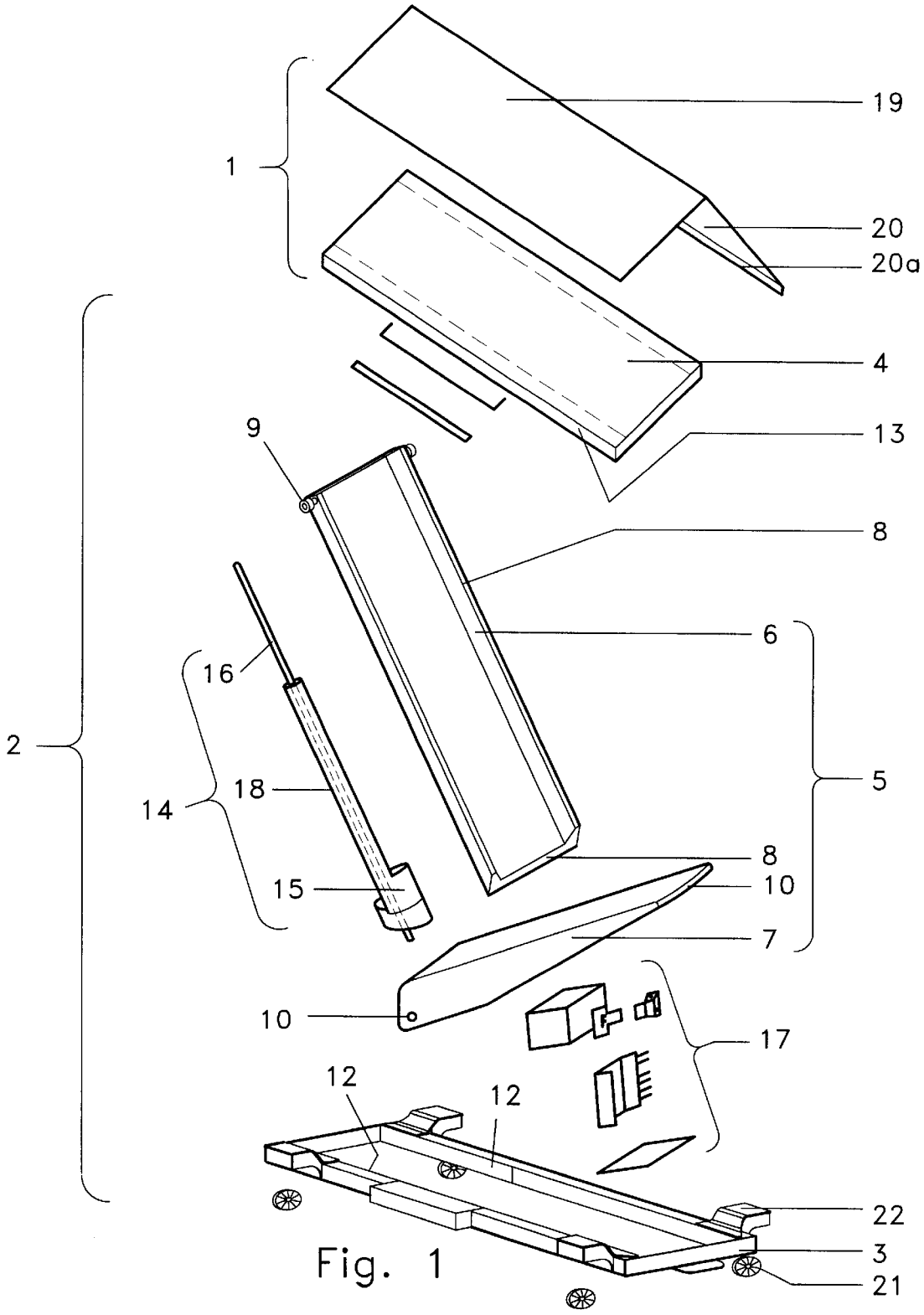
Figure 6:
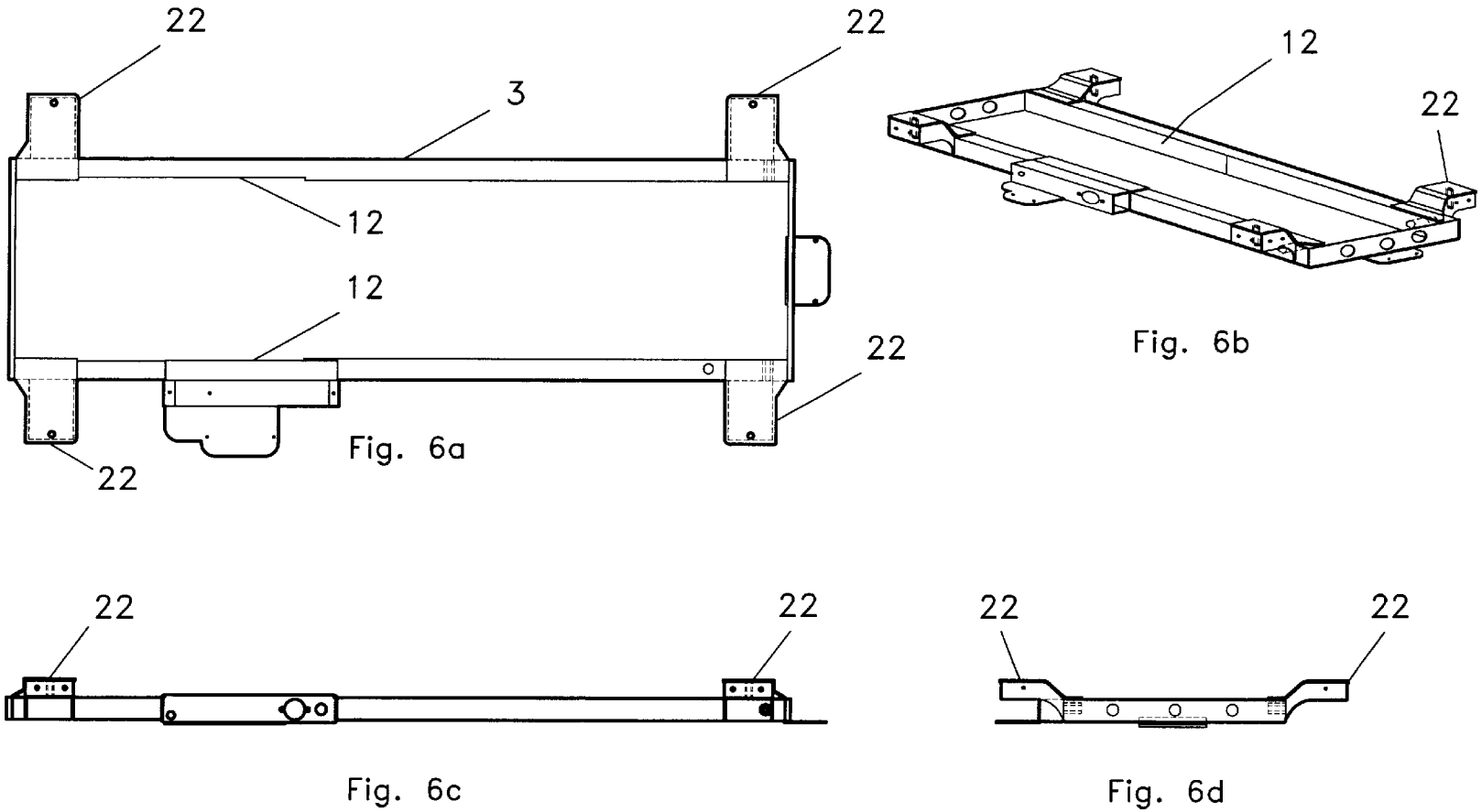
Figure 7:
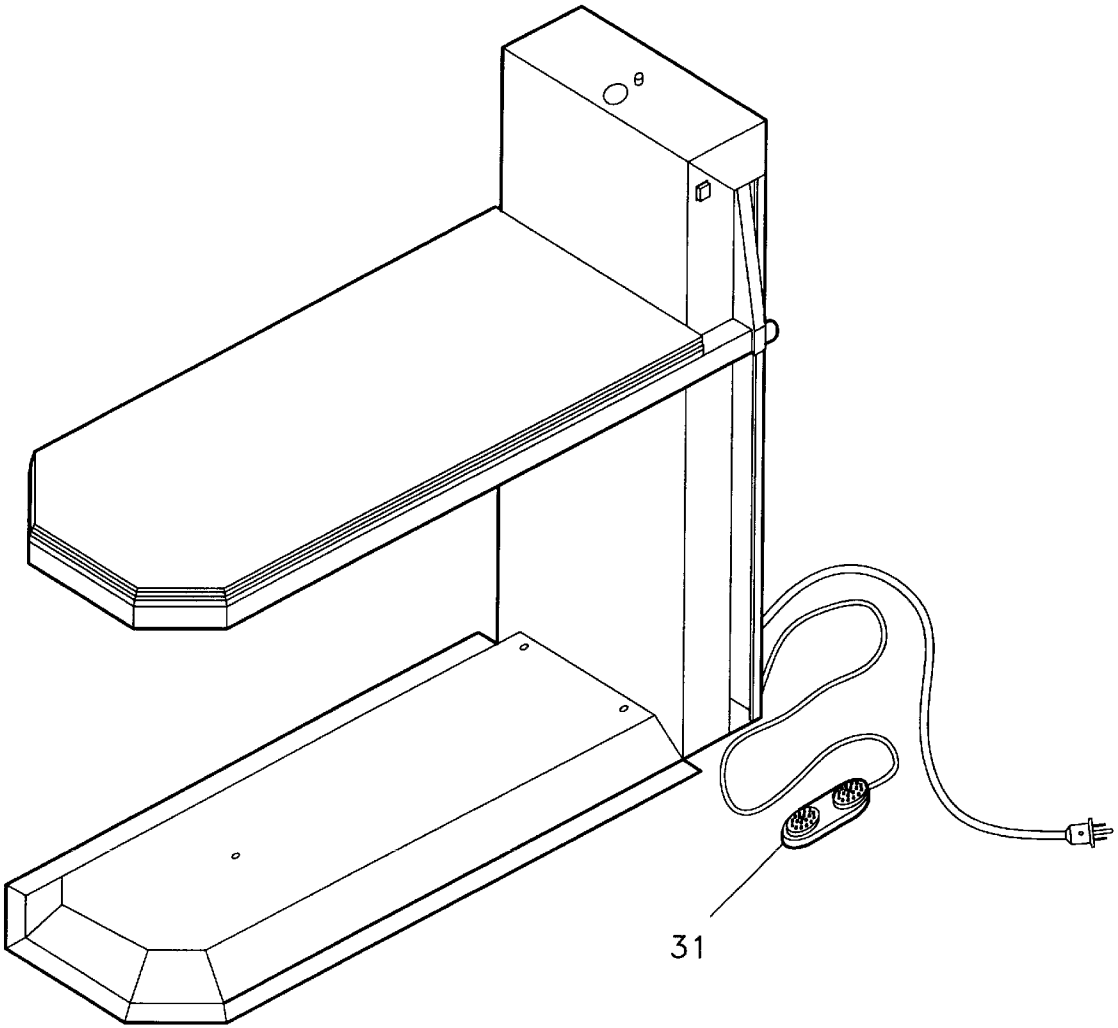

The basic concepts of the present invention may be implemented in a variety of ways. It involves the height adjustable table, the method of using the height adjustable table, different aspects of the height adjustable table such as a side sloping flange, mobility, a self-contained power unit, a wide center of gravity for stability, ease of height adjustment through manual or powered means, and folding of the height adjustable table. Furthermore, various aspects mentioned above may be applicable to a variety of devices and where applicable could include general medical support tables, work tables, and other devices.

The basic concept of the fixed embodiment of the present invention may be implemented in several ways, two of the most common uses would be positioning the device against the wall of an exam room where a non-lifting table would have been placed, thus replacing the non-lifting exam table with one that does lift. The second most common application is to use the device as an island piece either in the exam room or in the treatment area. This option is accomplished because the device is designed to be free standing or wall positioned. The device may use direct power from a 110 volt wall socket to power the elevating system. One of the features of the invention is its safety feature. When a subject, for example, a person's foot steps on the base without any attention, the table will automatically stop its operation no matter if it is going up towards a desired elevation or going down towards the base. Another feature of the invention is that, if electricity is out during an operation, the table can still be cranked manually to a desired position because of its unique design.

Various techniques related to the device and steps are inherent to the utilization. They may simply be the natural result of utilizing the device as intended and described. In addition, while some devices are disclosed, it would be understood that these not only accomplish certain methods, but also can be varied in numbers of ways. Importantly, as to all of the foregoing, all of the facets should be understood to be encompassed by this patent.

In regard to the general aspects, it can be seen that the present invention allows a user to easily relocate an animal to and from the upper surface of a veterinarian's preparation table with a great deal of flexibility not achieved in other devices. It can also be seen that the height of the table may be quickly adjusted to a variety of elevations suitable for different functions of the medical personnel. It can also be seen that the device may be fully mobile with a self contained power unit having a built-in power supply, if the device is indeed powered as opposed to manually actuated.

Having described some general aspects and functions of the present invention, reference is made to FIGS. 3 and 4. The preferred embodiment may have at least the following elements: a supporting table, a frame assembly, and a height adjustable elevation assembly, such as a scissor assembly as shown. The frame assembly (2) may comprise the following elements: a lower frame assembly (3), an upper frame assembly (4), and an elevation support assembly (5). The elevation support assembly may include a first leg assembly (6) and a second leg assembly (7). Each leg assembly may be connected at one end and allowed to slide at a second end. For instance, a first leg assembly (6) may be pivoted at a first pivot point (8) and allowed to a slide at first sliding section (9). Likewise, the second leg assembly may pivot at a second pivot point (10) and slide at a second sliding section (11). To enclose the sliding section along a track, the lower frame assembly (3) may include a lower track (12) on either side of the sliding section of the first leg assembly. Likewise, the upper frame assembly (4) may include a track or other constraining arrangement for an upper track (13) to constrain the sliding movement of the second leg assembly (7) and its second sliding section (11). Additionally, the sliding sections may include rollers, low friction slides such as Teflon®, or other suitable devices known to those with ordinary skill in the art.

To assist in elevation adjustments, an elevation assembly (14) may be connected to the height adjustable table (1). The elevation assembly (14) may be made from a variety of devices. They may include an electric screw actuator, a hydraulic cylinder, a pneumatic cylinder, a gas pressurized cylinder, mechanical devices such as jacks or winches, or any other suitable elevation assembly, whether manual or electric, to assist in raising the elevation of the table. For the preferred embodiment, the device chosen may be a low-voltage, such as 12 volt, powered electric screw actuator. As would be known to those skilled in the art, a motor (15), which may include a gear box, may be included in the elevation assembly (14). The gear box and motor may rotate and, therefore, adjust in and out the screw (16). As the screw adjusts in or out, if one end of the elevation assembly (14) is attached to the upper frame assembly (4) and the other end attached to, for instance, the lower frame assembly (3), the elevation of the upper frame assembly (4) would change with respect to the lower frame assembly (3). To assist in the powering of the electric screw actuator, a self-contained power unit (17) may be included. The power unit may contain such items such as a battery, a recharger, and various controls and relays, such as a charging outlet to plug into some remote A/C 110 volt or other power source. The power unit could be other than electrical, such as pneumatic and so forth. Furthermore, to assist in the ease of controlling the elevation assembly, an elevation actuator (18) may be used. The elevation actuator may take the form of a lever or other suitable actuator. In the preferred embodiment, two levers may be used, one for lowering and the other for raising the table. Obviously, other arrangements can be made such as a single level, toggle switch, foot pedal, and other generally known devices.

One key to the present invention is the shape of the table (19). The table may be flat on top and provide a suitable working surface for medical procedures. This table as disclosed above may have an adjustable height for performing various procedures and for use by various medical personnel with their own desired selective height. A further feature of the present invention regarding the table may be a side sloping flange or an angled ramp (20). The side sloping flange (20) may effectively lower the minimum height of the table. It may lower the lower edge **(20*a*) of the side sloping flange (20) within approximately one inch of the supporting surface of the table, such as a floor. By providing an incline, the side sloping flange (20) may allow the personnel to grasp the animal and slide the animal up the flange onto the top of the table when the table is perhaps in a lowered elevation. The side sloping flange (20)** may reduce the need for actually lifting the animal (as opposed to more conveniently sliding the animal) to the top of the table. Additionally, the table may be attached to the upper frame assembly with various shock absorbing inserts such as rubber grommets, pads, and so forth The top of the table may include a non-slip pad to assist in stabilizing the animal on the top of the table.

A further feature of the preferred embodiment may include rotatable elements (21) such as wheels, casters, and rollers. The rotatable elements may also be swiveled in order to further allow more precise articulation of the position of the height adjustable table (1). These rotatable elements may also include a braking assembly. The braking assembly may be centrally controlled or may be positioned on each rotatable element as shown in photograph 2. Similarly, the rotatable elements can be restrained into a non-swiveling position. A further feature of the preferred embodiment shows the outstretched arm (22) for the rotatable element (21). These outstretched arms may provide additional stability by increasing the center to center distance between the support points of the rotatable elements.

A typical method of using the present invention may include the following steps. The animal may be anesthetized or otherwise incapacitated or sedated. The animal may be located in a proximity of the front of the height adjustable table (1). The operator may lower the height adjustable table (1) to a minimum elevation (typically within one inch) from the supporting surface to the lower edge **(20*a*) of the side sloping flange (20). The personnel may reposition themselves to the back of the height adjustable table (1) (opposite the side sloping flange (20)), reach over the top of the table, grasp the animal, and pull the animal up the side sloping flange (20)** onto the top of the table. The table may be raised to a suitable elevation for performing the procedures desired. Upon completing the procedures, the table may be lowered to a suitable elevation, the animal slid off the top of the table and allowed to recover from the procedure and perhaps sedation. Additionally, the wheel brakes may be set while the animal is being slid onto the table and perhaps later reset to allow the table to be repositioned to a desired location.

Each of these height adjustable table embodiments could include various facets of the present invention. Some may include rotatable elements while others may not include such elements. Some may include varieties of elevation adjustments specific to the elevation adjustment assembly and particular needs of the marketplace. The marketplace and manufacturing concerns may dictate the appropriate embodiments for the present invention. For instance, the power source may be an A/C 110 volt supply, compressed air supply, or other power source, instead of a D/C powered portable unit.

Figure 8:
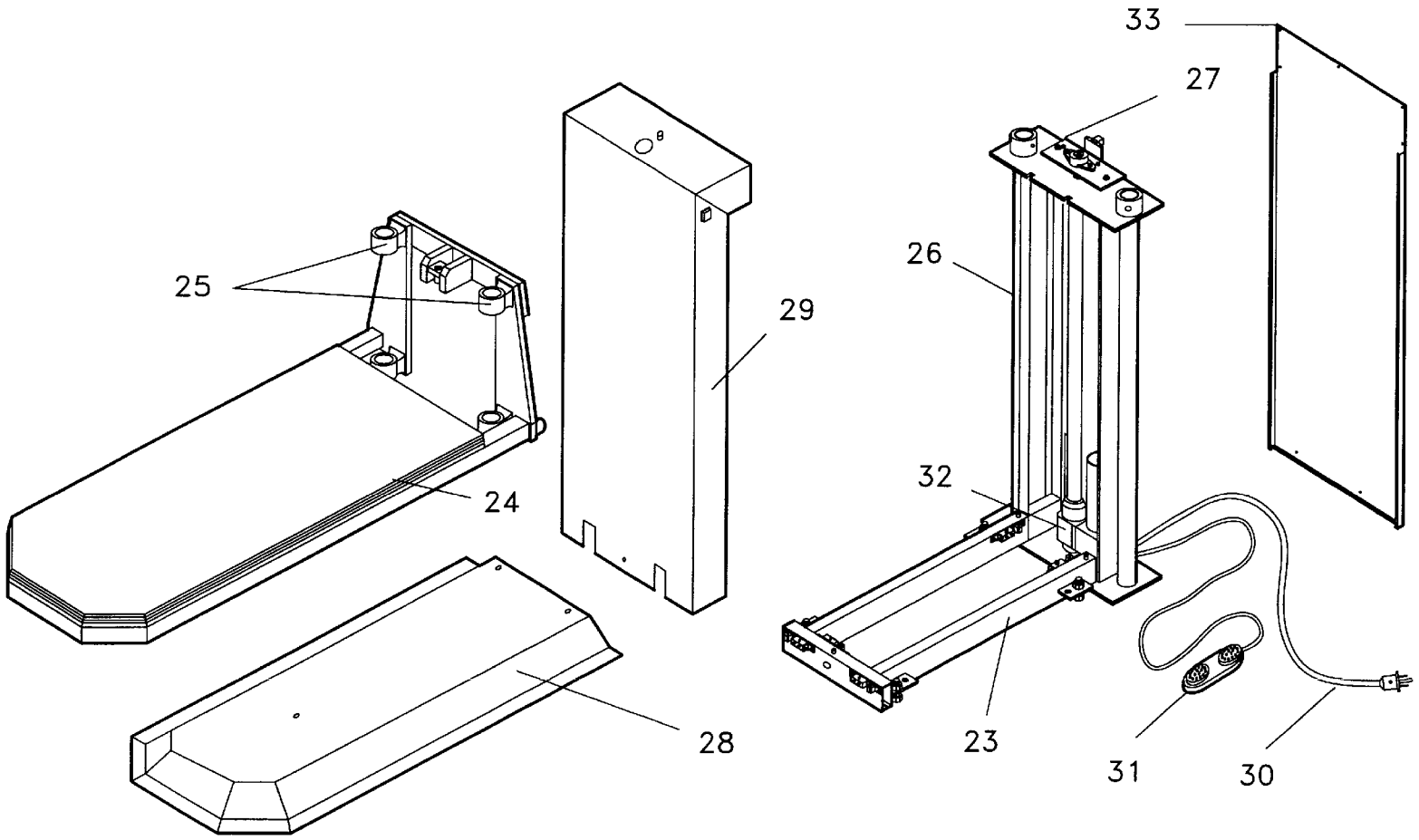

As for the fixed model the exploded view shown in FIG. 8 is comprised of seven elements which depict the major parts for assembly. The vertical frame assembly (23) may be the central piece for assembly, all other assembled pieces attach to it. The table assembly (24) slides onto the vertical frame assembly (23) by the use of the four round knuckles (25) which may slip over the two round tubular columns (26) the vertical frame assembly. To accomplish this, the top plate (26) shown on the vertical frame assembly (23) may be removed and then re-attached. The base safety cover (28) may attach to vertical frame assembly (23) at the horizontal base. The front cover assembly (27) may attach to the vertical frame assembly (23) on the front vertical surface. Power (30) and motor controls (31) may attach to vertical frame assembly (23) at the point of the actuator motor (32), near the base of the vertical stand. The back cover (33), may attach to vertical frame assembly (23) on the rear surface of the vertical stack.

The foregoing discussion and the claims that may ultimately follow in an application describe only the preferred embodiments of the present invention. Particularly with respect to any claims, it should be understood that a number of changes may be made without departing from the essence of the present invention. In this regard, it is intended such changes—to the extent that they substantially achieve the same results in substantially the same way—will still fall within the scope of the present invention.

It is simply not practical to describe all the possible embodiments to the present invention which may be accomplished generally in keeping with the goals and objects of the present invention and this disclosure which may include separately or collectively such aspects as mobility, elevation adjustment, table configuration, and other aspects of the present invention that are intended to be encompassed by the present invention.

I claim:

1. A veterinary medical lift device, comprising:

a. a table surface;

b. an upper frame assembly to which said table surface responds;

c. a height adjustable elevation support assembly coupled to said upper frame assembly;

d. a lower frame assembly coupled to said height adjustable elevation support assembly;

e. an elevation assembly connected to said height adjustable elevation support assembly, whereby operation of said elevation assembly actuates said height adjustable elevation support assembly to adjust the distance between said upper frame assembly and said lower frame assembly; and f. a discrete power source to which said elevation assembly operably responds, wherein said discrete power source is attached to said height adjustable elevation support assembly.

2. A veterinary medical lift device as described in claim 1, wherein said height adjustable elevation support assembly coupled to said table surface upper frame assembly comprises a first leg assembly and a second leg assembly, and wherein said second leg assembly is rotationally coupled to said first leg assembly, and wherein said first leg assembly comprises:

a. a first pivot point; and b. a first sliding element; and wherein said second leg assembly comprises:

c. a second pivot point; and d. a second sliding element.

3. A veterinary medical lift device as described in claim 2, wherein said discrete power source is located within said first leg assembly.

4. A veterinary medical lift device as described in claim 2, wherein said discrete power source is located within said second leg assembly.

5. A veterinary medical lift device as described in claim 3, wherein said wherein said first leg assembly encloses said discrete power source.

6. A veterinary medical lift device as described in claim 4, wherein said second leg assembly encloses said discrete power source.

7. A veterinary medical lift device as described in claim 1, wherein said discrete power source is a battery.

8. A veterinary medical lift device as described in claim 7, where said battery is rechargeable.

9. A veterinary medical lift device as described in claim 8, further comprising a battery recharger.

10. A veterinary medical lift device as described in claim 9, wherein said battery recharger comprises a discrete battery recharger attached to said height adjustable elevation support assembly.

11. A veterinary medical lift device as described in claim 10, wherein said first leg assembly encloses said discrete battery recharger.

12. A veterinary medical lift device as described in claim 10, wherein said second leg assembly encloses said discrete battery recharger.

13. A veterinary medical lift device as described in claim 11 or 12, wherein said battery and said battery recharger are enclosed in the same leg assembly.

14. A veterinary medical lift device as described it claim 13, wherein said height adjustable elevation support assembly comprises a scissor assembly.

15. A veterinary medical lift device as described in claim 1, further comprising a movement element.

16. A veterinary medical lift device as described in claim 15, further comprising a brake assembly.

17. A veterinary medical lift device as described in claim 1, wherein said wherein said table surface further comprises at least one intravenous pole accommodation.

18. A veterinary medical lift device as described in claim 1, wherein said table surface has a width of less than about 30 inches.

19. A veterinary medical lift device as described in claim 1, wherein said table surface further comprises an angled ramp positioned so as to coordinate with said table surface at least when said table surface is in a lowered position.

20. A veterinary medical lift device as described in claim 19, wherein said angled ramp and with said table surface.

21. A veterinary medical lift device as described in claim 20, wherein said angled ramp is smoothly extended from said table surface.

22. A veterinary medical lift device as described in claim 21, wherein said table surface has a longitudinal side and wherein said angled ramp extends from the longitudinal side of said table surface.

23. A veterinary medical lift device as described in claim 22, wherein at least said table surface is in said lowered position near a floor and wherein said angled ramp extends to near said floor surface.

24. A veterinary medical lift device as described in claim 23, wherein said table surface in said lowered position extends to within about one inch from said floor surface.

25. A veterinary medical lift device as described in claim 24, wherein said angled ramp comprises a sloping flange.

26. A veterinary medical lift device as described in claim 1, wherein said table surface and said upper frame assembly comprise as a single continuous piece.

27. A method for veterinary treatment, comprising the steps of:

a. establishing a table surface at a first elevation in response to movement of an upper frame assembly coupled to said surface;

b. adjusting a height adjustable elevation support assembly to generate movement of said upper frame assembly;

c. coupling a lower frame assembly to said height adjustable elevation support assembly;

d. operating an elevation assembly, whereby operation of said elevation assembly adjusts said adjustable elevation support assembly;

e. powering said elevation assembly with a discrete power source attached to said height adjustable elevation support assembly; and f. positioning said table surface to a second elevation.

28. A method for veterinary treatment as described in claim 27, wherein said step of powering elevation support said elevation assembly with a discrete power source attached to said height adjustable elevation support assembly comprises the step of powering said elevation assembly with a discrete power source attached to a scissor assembly.

29. A method for veterinary treatment as described in claim 28, wherein said step of powering said elevation assembly with a discrete power source contained within said scissor assembly comprises the step of utilizing a DC power source to power said elevation assembly.

30. A method for veterinary treatment as described in claim 29, wherein said step of utilizing a DC power source located within said scissor assembly comprises the step of locating a battery one leg assembly.

31. A method for veterinary treatment as described in claim 30, wherein said elevation assembly comprises an electrical screw actuator.

32. A method for veterinary treatment as described in claim 28, further comprising the step of recharging said battery by utilizing a discrete battery recharger located within said scissor assembly.

33. A method for veterinary treatment as described in claim 28, wherein said scissor assembly comprises coupling a first leg assembly and a second leg assembly on a rotation axis having a location on said first leg assembly between:

a. a first pivot point; and b. a first sliding element; and having a location on said second leg assembly between:

c. a second pivot point; and d. a second sliding element.

34. A method for veterinary treatment as described in claim 27, wherein said step of positioning said table surface to a second elevation comprises the step of positioning said table surface between about seven inches and about thirty-eight inches.

35. A method for veterinary treatment as described in claim 27, further comprising the step of establishing a movement element.

36. A method for veterinary treatment as described in claim 35, wherein said step of establishing a movement element comprises the step of employing at least three wheels.

37. A method for veterinary treatment as described in claim 36, further comprising the step of employing a braking assembly.

38. A method for veterinary treatment as described in claim 27, further comprising the step of changing said table surface.

39. A method for veterinary treatment as described in claim 27, further comprising the steps of:

a. establishing a table surface in a lowered position near said floor surface;

b. creating an angled ramp that is near said floor and that is positioned so as to coordinate with said table surface;

c. placing an animal onto said table surface by sliding said animal up said angled ramp;

d. raising said animal on said table surface to a desired elevation; and e. performing a procedure on said animal.

40. A method for veterinary treatment as described in claim 39, wherein said step of creating a ramp that is near said floor and that is positioned so as to coordinate with said table surface comprises the step of providing said ramp and said table surface as a single continuous piece.

41. A method for veterinary treatment as described in claim 27, wherein said table surface and said upper frame assembly comprise as a single continuous piece.

42. A method for veterinary treatment as described in claim 27, wherein said step of adjusting a height adjustable elevation support assembly to generate movement of said upper frame assembly comprises coupling a first leg assembly and a second leg assembly on a rotation axis having a location on said first leg assembly between:

a. a first pivot point; and b. a first sliding element; and having a location on said second leg assembly between:

c. a second pivot point; and d. a second sliding element.

* * * * *